US011241894B2

(12) United States Patent
Hinnenkamp

(10) Patent No.: US 11,241,894 B2
(45) Date of Patent: Feb. 8, 2022

(54) INKJET PRINTING ON PLASTIC CARDS

(71) Applicant: Entrust Corporation, Shakopee, MN (US)

(72) Inventor: Brendan Hinnenkamp, Shakopee, MN (US)

(73) Assignee: Entrust Corporation, Shakopee, MN (US)

( * ) Notice: Subject to any disclaimer, the term of this patent is extended or adjusted under 35 U.S.C. 154(b) by 0 days.

(21) Appl. No.: 17/029,625

(22) Filed: Sep. 23, 2020

(65) Prior Publication Data

US 2021/0086530 A1 Mar. 25, 2021

Related U.S. Application Data

(60) Provisional application No. 62/904,031, filed on Sep. 23, 2019.

(51) Int. Cl.
*B41J 11/00* (2006.01)
*B41J 3/407* (2006.01)

(52) U.S. Cl.
CPC ..... *B41J 11/00218* (2021.01); *B41J 3/407* (2013.01)

(58) Field of Classification Search
CPC ..... B41J 11/00218; B41J 3/407
See application file for complete search history.

(56) References Cited

U.S. PATENT DOCUMENTS

| | | | |
|---|---|---|---|
| 4,825,054 | A | 4/1989 | Rust et al. |
| 4,995,501 | A | 2/1991 | Lundstrom |
| 5,266,781 | A | 11/1993 | Warwick et al. |
| 5,837,991 | A | 11/1998 | LaManna et al. |
| 6,131,817 | A | 10/2000 | Miller |
| 6,695,205 | B1 | 2/2004 | Lundstrom et al. |
| 6,783,067 | B2 | 8/2004 | Guenter et al. |
| 6,902,107 | B2 | 6/2005 | Shay et al. |
| 7,286,257 | B1 | 10/2007 | Morgavi |
| 7,398,972 | B2 | 7/2008 | Schuller et al. |
| 7,434,728 | B2 | 10/2008 | Paulson et al. |
| 2007/0187870 | A1 | 8/2007 | Lundstrom et al. |
| 2013/0220984 | A1 | 8/2013 | Cronin et al. |
| 2017/0200074 | A1* | 7/2017 | Beech ..... B41J 13/12 |
| 2018/0326763 | A1 | 11/2018 | Wooldridge |

* cited by examiner

*Primary Examiner* — Justin Seo
(74) *Attorney, Agent, or Firm* — Hamre, Schumann, Mueller & Larson, P.C.

(57) ABSTRACT

Inkjet printing on a plastic card using a radiation curable ink is described herein. After the ink is applied to the card surface (i.e. the printed surface), radiation, such as UV radiation, is directed onto a non-printed surface of the card (for example, a perimeter side edge surface and/or a surface of the plastic card opposite the printed surface the radiation curable ink is applied to) in order to at least partially cure any of the applied ink that may have flowed onto or that may otherwise be disposed on the non-printed surface. This prevents contamination of a drive mechanism used to transport the plastic card via the perimeter side edge surfaces or via the opposite surface prior to full curing of the ink applied to the printed surface.

17 Claims, 7 Drawing Sheets

INKJET PRINTING ON PLASTIC CARDS

FIELD

This disclosure relates to inkjet printing on plastic cards such as financial (e.g., credit, debit, or the like) cards, driver's licenses, national identification cards, business identification cards, gift cards, and other plastic cards, and to curing (partially or completely) various surfaces of the plastic cards.

BACKGROUND

Inkjet printing using radiation curable ink on plastic cards is known in the art. Inkjet printing is used to print data, graphics, images and the like on front and/or back surfaces of the plastic cards. In some circumstances, it is desirable to print on the entire surface of the plastic card from the leading end to the trailing end and from the first longitudinal side to the second longitudinal side. This is referred to as edge-to-edge printing. After the ink is applied to the surface, a period of time is provided to allow the applied ink to properly disperse over the surface, thereafter followed by radiation, such as ultraviolet (UV) radiation, being applied to the surface to cure the applied ink.

To achieve a desired card printing rate, i.e. the number of plastic cards printed per unit of time, it is desirable to transport the plastic card immediately after applying the ink thereto and prior to fully curing the applied ink to permit a new plastic card to be input for printing thereon. To avoid marring of the ink applied to the surface, it is necessary to transport the plastic card using a transport mechanism, such as drive rollers, that does not contact the surface to which the ink has been applied, i.e. the transport mechanism contacts only the perimeter side edge surfaces of the plastic card or contacts only the surface opposite the surface to which the ink has been applied. However, when ink is applied near an edge of the plastic card, during the time period provided to allow the applied ink to disperse, a portion of the applied ink may flow over the printed surface and onto one or more of the perimeter side edge surfaces of the plastic card. In some instances, the applied ink may even flow onto a portion of the surface opposite the surface to which the ink has been applied. If this occurs, the transport mechanism that transports the plastic card prior to curing of the ink may become contaminated by the uncured ink on the perimeter side edge surface(s) or on the opposite surface.

SUMMARY

Inkjet printing on a plastic card using a radiation curable ink is described herein. The plastic cards can include, but are not limited to, financial (e.g., credit, debit, or the like) cards, driver's licenses, national identification cards, business identification cards, gift cards, and other plastic cards. After the ink is applied to the card surface (i.e. the printed surface), radiation, such as UV radiation, is directed onto a non-printed surface of the card (for example, a perimeter side edge surface and/or a surface of the plastic card opposite the printed surface the radiation curable ink is applied to) in order to at least partially cure any of the applied ink that may have flowed onto or that may otherwise be disposed on the non-printed surface. This prevents contamination of a drive mechanism used to transport the plastic card via the perimeter side edge surfaces or via the opposite surface.

The techniques described herein facilitate edge-to-edge inkjet printing on plastic cards. However, the techniques described herein are not limited to edge-to-edge printing on plastic cards. In some non-edge-to-edge printing embodiments, radiation curable ink may be applied to a surface of the plastic card only near one or more edges but not near one or more other edges. In such embodiments, radiation may only need to be applied to a non-printed surface located near the printed surface portion.

The radiation that is directed onto the non-printed surface(s) may partially cure any radiation curable ink thereon or may fully cure any radiation curable ink thereon. The partial or full curing of any radiation curable ink on the non-printed surface(s) can occur prior to the applied radiation curable ink on the printed surface being fully cured. In other embodiments, the partial or full curing of any radiation curable ink on the non-printed surfaces can occur simultaneously, or substantially simultaneously, with curing of the applied radiation curable ink on the printed surface. Regardless of how the curing on the non-printed surface is characterized, the amount of curing that occurs is sufficient to prevent unwanted contamination by the radiation curable ink of a drive mechanism used to subsequently drive the plastic card by engaging the non-printed surface. Curing of any radiation curable ink on the non-printed surface may also be referred to herein as pinning or UV pinning. The term curing as used herein by itself (i.e. not modified by a modifier such as partial or full/complete) is intended to encompass either partial curing or full/complete curing.

In one embodiment, a method of inkjet printing on a plastic card can include applying radiation curable ink to a first surface of the plastic card near at least one edge thereof. Thereafter, electromagnetic radiation, such as UV radiation, is discharged from an electromagnetic radiation source, such as a UV light source, and at least a portion of the discharged electromagnetic radiation is directed, for example by reflection or any other technique, onto a non-printed surface of the plastic card using at least one optical instrument to thereby at least partially cure any of the radiation curable ink on the non-printed surface. The optical instrument(s) can be any one or more optical instruments suitable for achieving the desired direction of the electromagnetic radiation onto the non-printed surface(s) described herein including, but not limited to, one or more mirrors, one or more focusing lenses, one or more optical fibers, one or more light pipes, and the like, and combinations thereof.

In another embodiment, a method of processing a plastic card can include applying radiation curable ink to a first surface of the plastic card in a plastic card printing station having a plastic card inkjet printing mechanism. Thereafter any of the radiation curable ink on a non-printed surface of the plastic card is at least partially cured using electromagnetic radiation, for example UV radiation, directed onto the non-printed surface using at least one optical instrument.

Additional processing can occur on the plastic card prior to and/or after the printing. For example, an integrated circuit chip on the plastic card can be programmed with data and/or data read therefrom, data can be read from and/or written onto a magnetic stripe on the plastic card, a laminate can be applied to the plastic card, the plastic card can be embossed or indented, as well as other card processing known in the art.

In another embodiment, a plastic card processing system can include a plastic card printing station having a plastic card inkjet printing mechanism that applies radiation curable ink to a first surface of a plastic card. In addition, the system can include an electromagnetic radiation source that generates and discharges electromagnetic radiation, and at least one optical instrument that is positioned relative to the electromagnetic radiation source to receive at least a portion of the electromagnetic radiation discharged by the electromagnetic radiation source and that is configured to direct electromagnetic radiation onto a non-printed surface of the plastic card.

In some embodiments, the techniques described herein are not limited to inkjet printing of radiation curable ink, and can be applied to other radiation curable materials applied to plastic cards, such as, but not limited to, radiation curable coatings.

DRAWINGS

Figure 3:
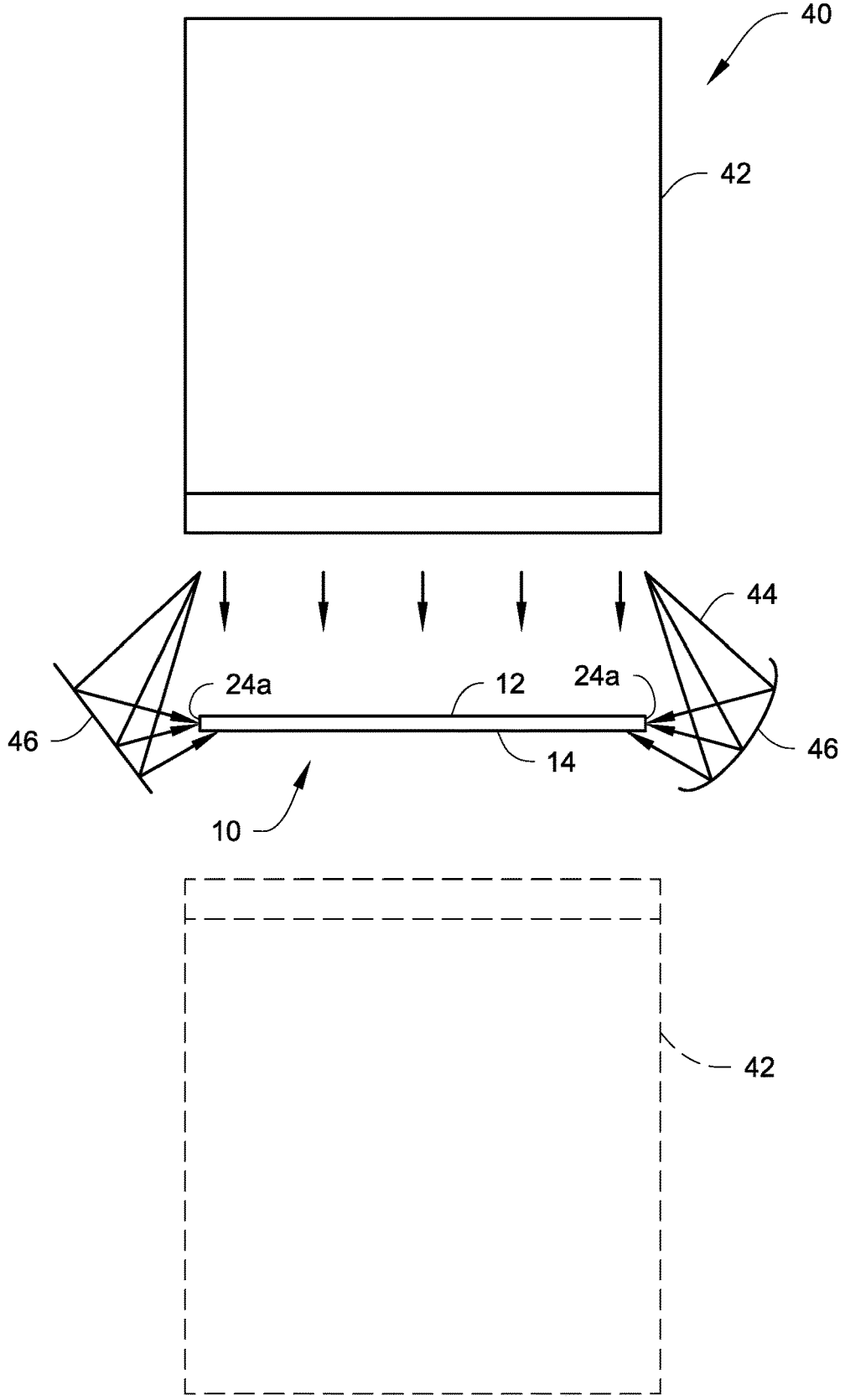

FIG. 3 schematically depicts one embodiment of a non-printed surface curing station described herein.

Figure 4:
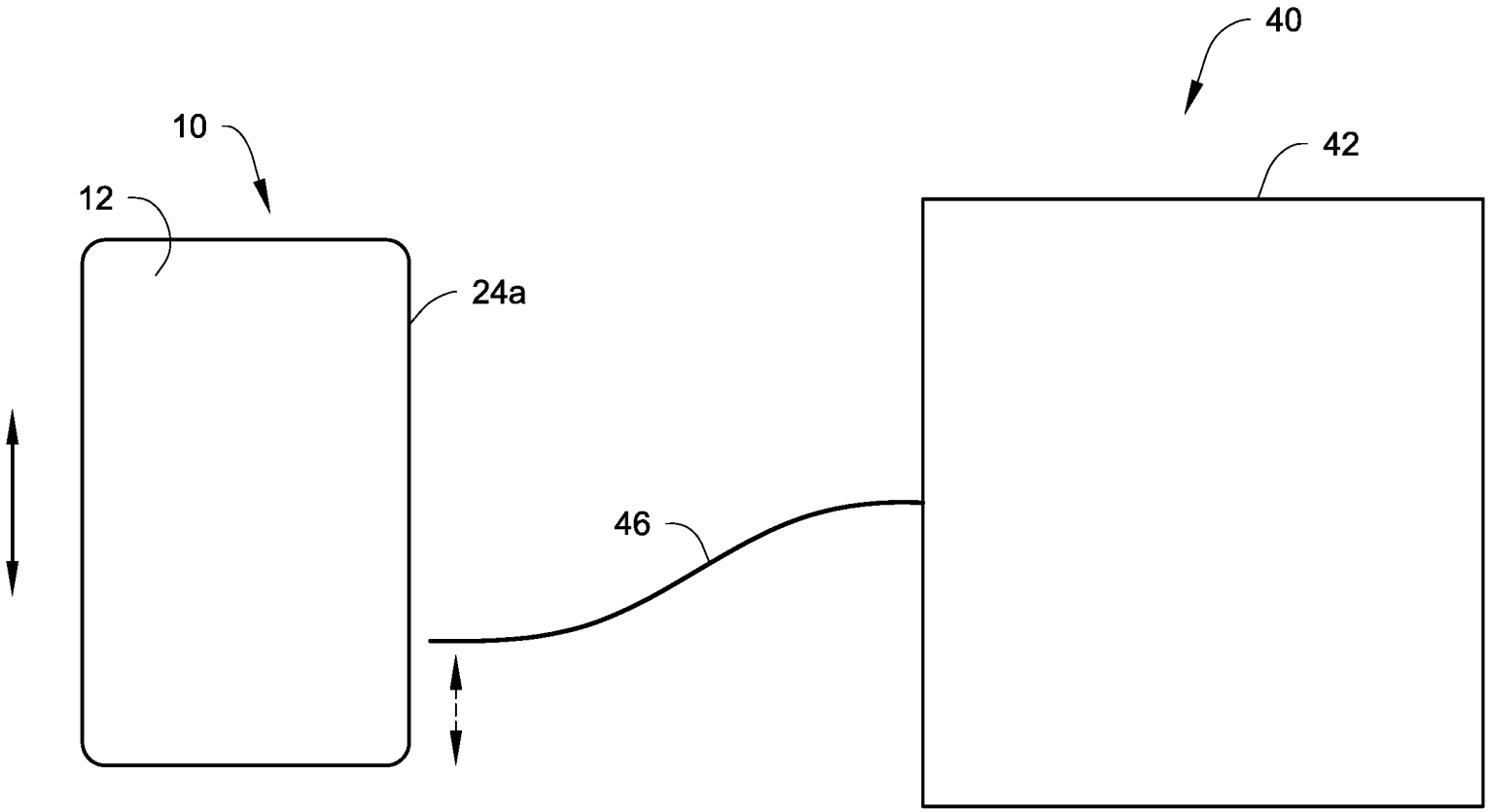

FIG. 4 schematically depicts another embodiment of a non-printed surface curing station described herein.

Figure 5:
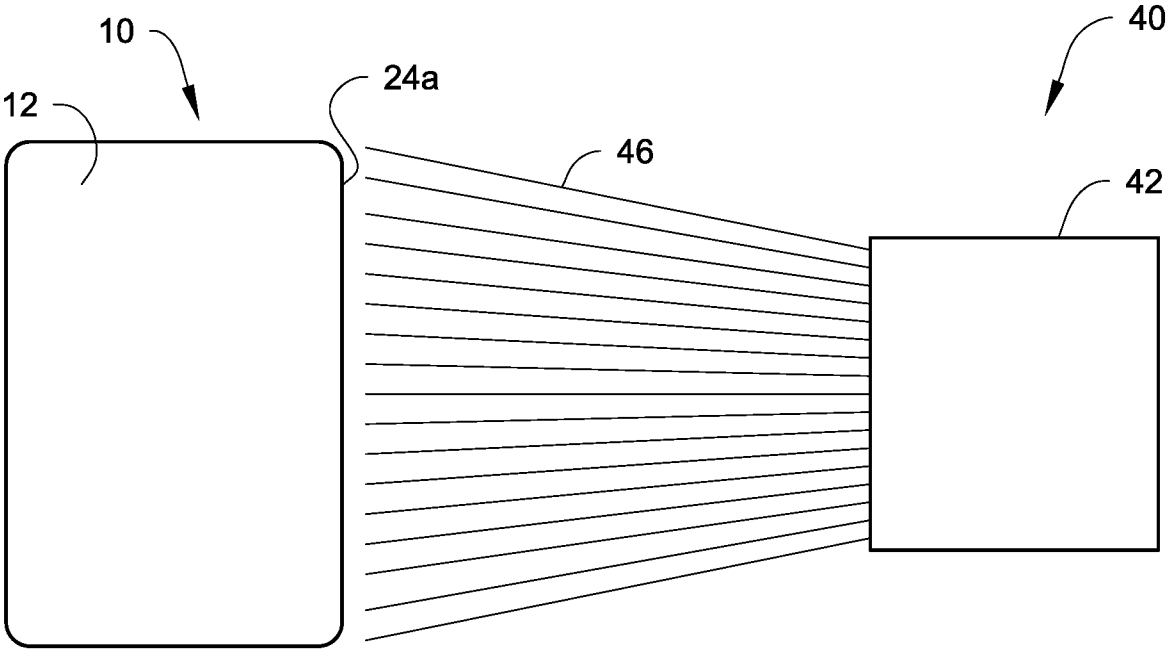

FIG. 5 schematically depicts another embodiment of a non-printed surface curing station described herein.

Figure 6:
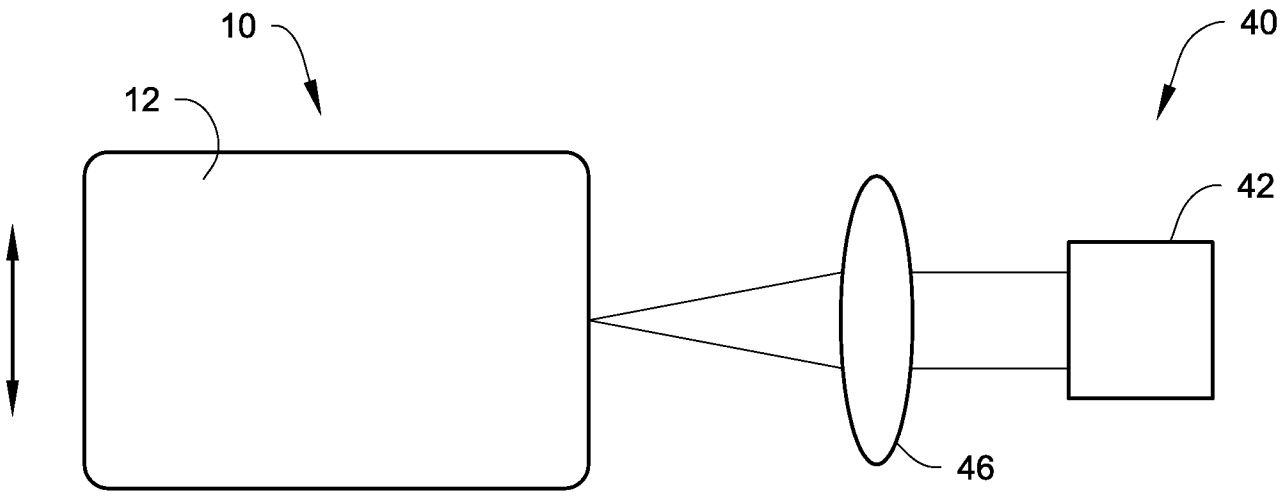

FIG. 6 schematically depicts another embodiment of a non-printed surface curing station described herein.

Figure 7:
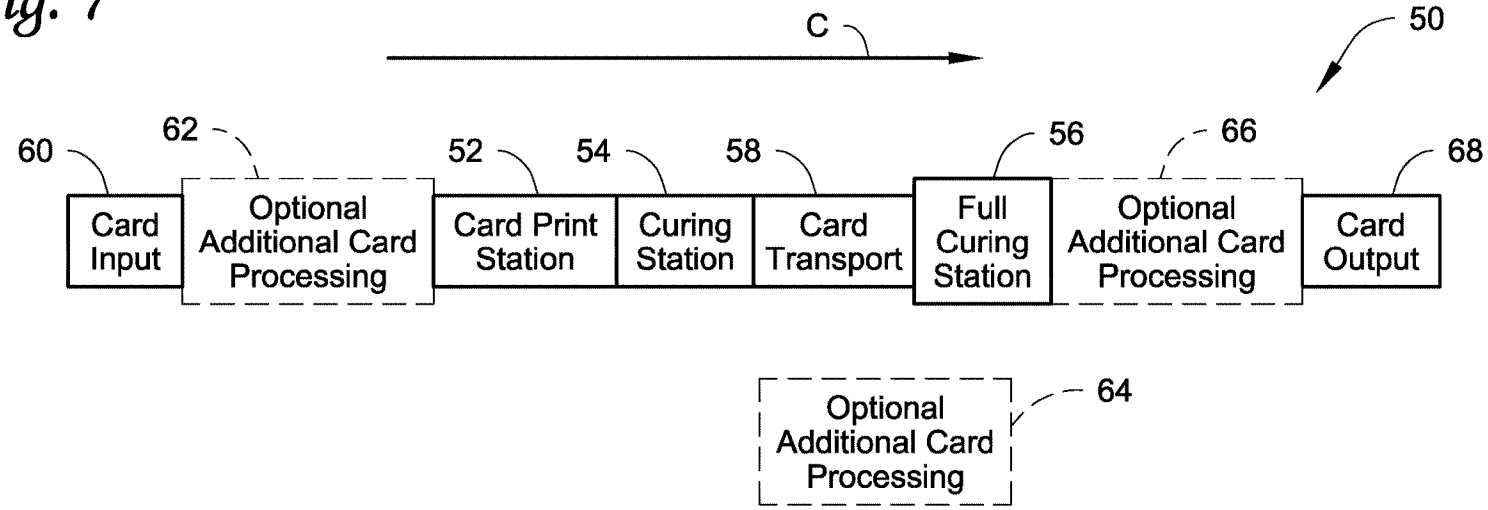

FIG. 7 schematically depicts one embodiment of a plastic card processing system in which the techniques described herein can be implemented.

Figure 8:
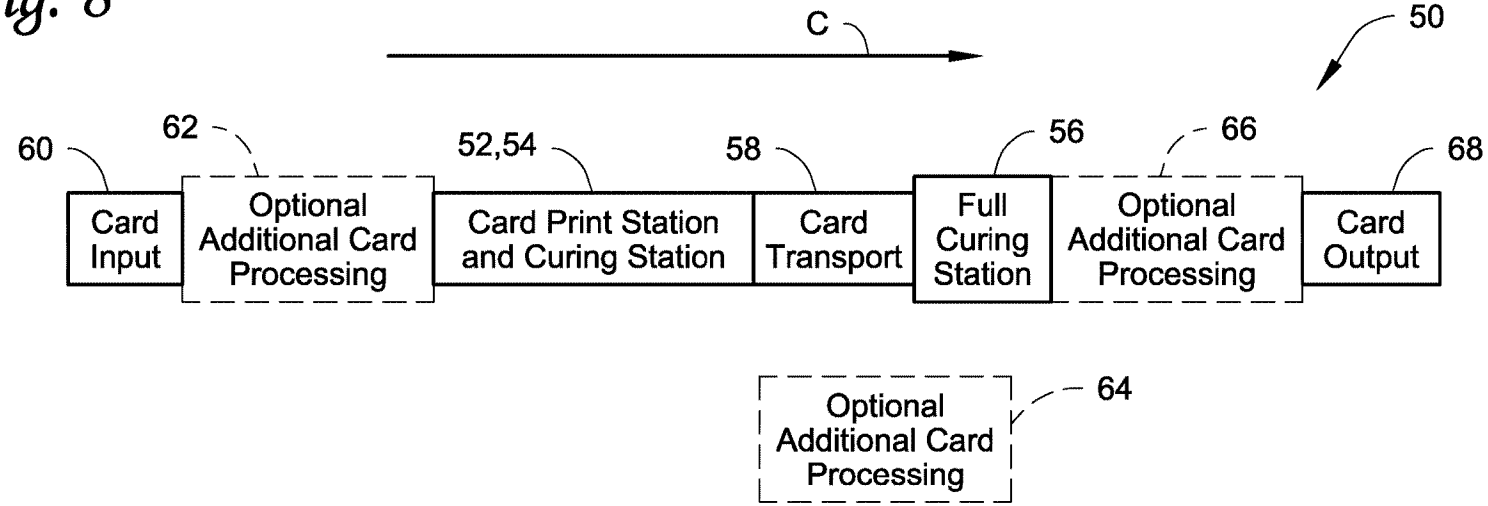

FIG. 8 schematically depicts another embodiment of a plastic card processing system in which the techniques described herein can be implemented.

Figure 9:
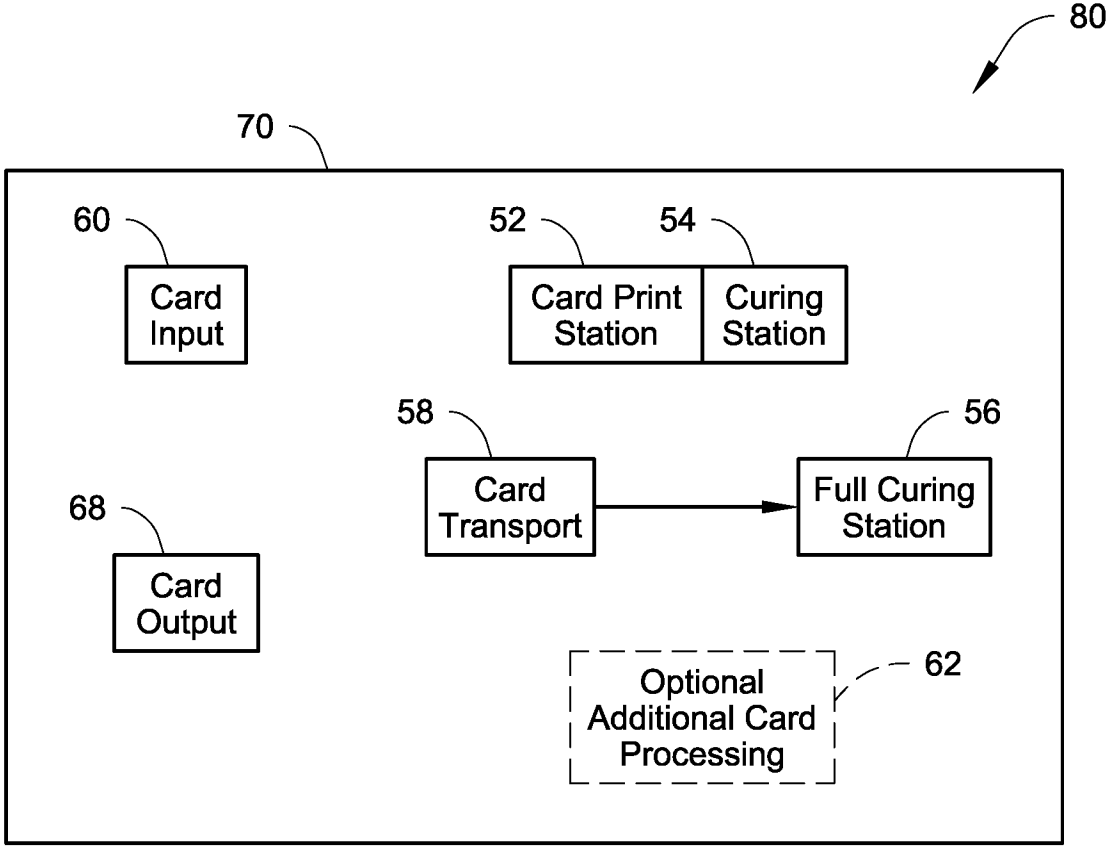

FIG. 9 schematically depicts another embodiment of a plastic card processing system in which the techniques described herein can be implemented.

DETAILED DESCRIPTION

The following definitions are provided to help facilitate an understanding of the concepts described herein:

a. A printed surface is the surface of the plastic card (typically either the top surface or the bottom surface) to which the radiation curable ink is directly applied by the inkjet printing mechanism.

b. A non-printed surface is a surface of the plastic card to which the radiation curable ink is not directly applied by the inkjet printing mechanism. The non-printed surface includes the perimeter side edge surface as well as the surface of the plastic card opposite the printed surface. For example, if the printed surface is the top surface of the plastic card, the non-printed surface is some or all of the perimeter side edge surface and/or some or all of the bottom surface. Likewise, if the printed surface is the bottom surface of the plastic card, the non-printed surface is some or all of the perimeter side edge surface and/or some or all of the top surface.

c. The perimeter side edge surface is the perimeter surface of the plastic card between the top and bottom surfaces. The perimeter side edge surface forms the thickness of the plastic card.

d. Cure, cured or curing used by itself without a modifier encompasses either partial or full/complete curing of the radiation curable ink.

e. Full/complete curing or the like refers to a complete generation of a crosslinked network of polymers in the radiation curable ink.

f. Partial curing or the like refers to a partial generation of a crosslinked network of polymers in the radiation curable ink.

Figure 2B:
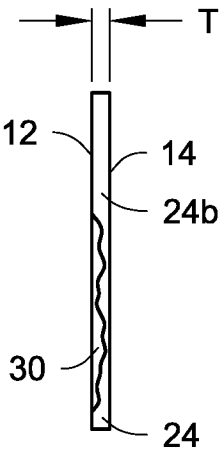
FIG. 2B is an end view looking in the direction of arrow B in FIG. 1 of an end side edge surface of the plastic card.
Figure 1:
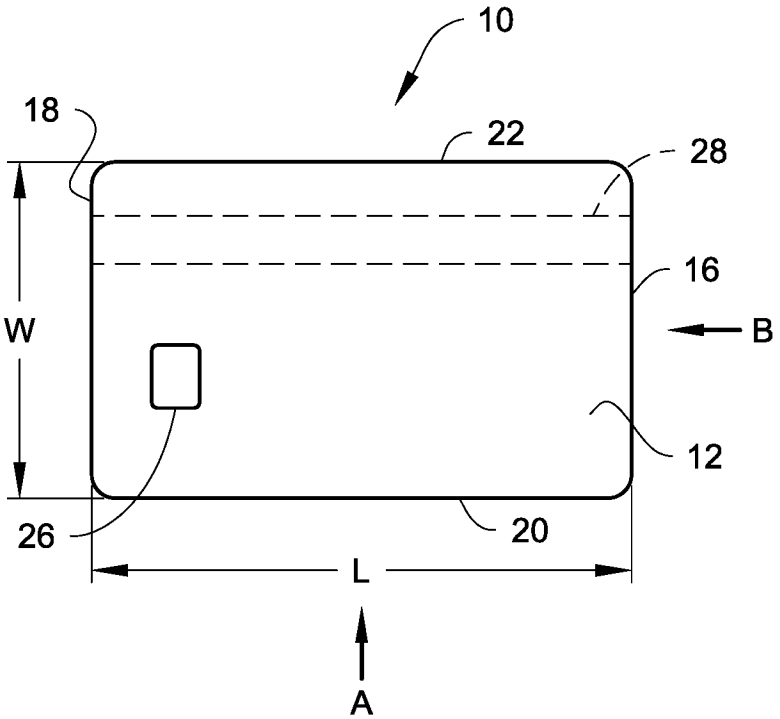
FIG. 1 is a top view of a top/bottom surface of one example of a plastic card described herein.
Figure 2A:
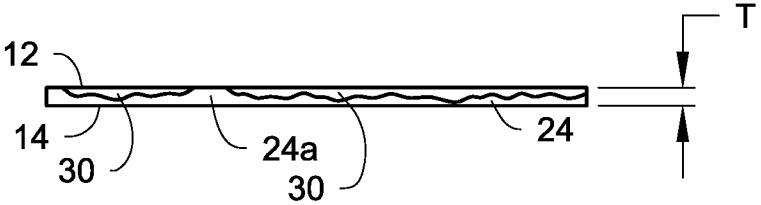
FIG. 2A is a side view looking in the direction of arrow A in FIG. 1 of a longitudinal side edge surface of the plastic card.

Referring to FIGS. 1, 2A and 2B, an example of a plastic card 10 upon which radiation curable ink, such as UV ink, can be applied in a plastic card inkjet printing mechanism is illustrated. The plastic card 10 can include, but is not limited to, a financial (e.g., credit, debit, or the like) card, a driver's license, a national identification card, a business identification card, a gift card, and other plastic cards. The plastic card 10 includes a first surface 12 and a second surface 14 opposite the first surface 12. The first surface 12 may be considered the top surface of the plastic card 10 or the bottom surface of the plastic card 10. Likewise, the second surface 14 may be considered the bottom surface of the plastic card 10 or the top surface of the plastic card 10. To simplify the description, the first surface 12 will be considered the top surface, while the second surface 14 will be considered the bottom surface.

In the top view of FIG. 1, the plastic card 10 further includes a first end edge 16, a second end edge 18, a first longitudinal side edge 20, and a second longitudinal side edge 22. A length L is defined between the first end edge 16 and the second end edge 18, and a width W is defined between the first longitudinal side edge 20 and the second longitudinal side edge 22. In one embodiment, the plastic card 10 can have a length L of about 85.60 mm and a width W of about 53.98 mm. However, other card lengths L and widths W are possible.

Referring to FIGS. 2A and 2B, a perimeter side edge surface 24 is defined between the first surface 12 and the second surface 14 and defines the perimeter of the plastic card 10. The side edge surface 24 defines a thickness T of the plastic card 10 between the first surface 12 and the second surface 14. In one embodiment, the thickness T can be about 0.76 mm. However, other card thicknesses T are possible. The thickness T is exaggerated in FIGS. 2A and 2B to help explain the concepts described herein.

Returning to FIG. 1, the first surface 12 can be printed with background graphics (not shown) as well as a logo and the name of the card issuer (not shown). In some embodiments, the first surface 12 may also be printed with various data (not shown) relating to the intended cardholder such as, but not limited to, an image of the intended cardholder, the name of the intended cardholder, an account number, a card expiration date, and other printed data known in the art of plastic cards. At least some of the printing on the first surface 12 is inkjet printing using the radiation curable ink. In addition to inkjet printing, other printing techniques can be used, such as retransfer printing, laser marking, thermal transfer, and other printing known in the art, to apply printing to the first surface 12.

The second surface 14 can also be printed with background graphics (not shown); various data (not shown) relating to the intended cardholder such as, but not limited to, the name of the intended cardholder, an account number, a card verification value number, a card expiration date, and other printed data known in the art of plastic cards; card issuer contact information; and other data. At least some of the printing on the second surface 14 may be inkjet printing using the radiation curable ink. In addition to inkjet printing, other printing techniques can be used, such as retransfer printing, laser marking, thermal transfer, and other printing known in the art, to apply printing the second surface 14.

The first surface 12 and the second surface 14 may also be provided with various other features. For example, as shown in FIG. 1, the card 10 may be provided with an integrated circuit chip 26 that is accessible via the first surface 12 (or alternatively via the second surface 14) and/or a magnetic stripe 28 (shown in dashed lines) on the second surface 14. The integrated circuit chip 26, which can be a contact chip or a contactless chip, can be electronically programmed with data and/or data can be electronically read therefrom using an integrated circuit chip programming device known in the art. The magnetic stripe 28 (if present) can have data magnetically written to and/or data read therefrom using a suitable magnetic stripe read/write device known in the art.

Some of the printing that takes place on the first surface 12 or on the second surface 14 may occur by inkjet printing using a radiation curable ink such as UV ink. To facilitate the description, it will be assumed that the first surface 12 is the printed surface to which the radiation curable ink is to be applied. However, the second surface 14 could be the printed surface, or after the first surface 12 is printed, the second surface 14 could later be subject to inkjet printing and become the printed surface.

Assuming the first surface 12 is the printed surface, some of the inkjet printing may take place near one or more of the edges 16, 18, 20, 22, or in the case of edge-to-edge printing, the inkjet printing may take place near all of the edges 16, 18, 20, 22. However, when inkjet printing near an edge, some of the applied ink may inadvertently flow from the first surface 12 (or printed surface) onto the perimeter side edge surface 24 of the card 10, i.e. the applied ink may flow onto one or more of a first longitudinal side edge surface 24*a*, a second longitudinal side edge surface (not shown) opposite the first longitudinal side edge surface 24*a*, a first end side edge surface 24*b*, and/or onto a second end side edge surface (not shown) opposite the first end side edge surface 24*b*. This overflow of the applied ink from the first surface 12 onto the side edge surfaces 24*a*, 24*b* is indicated by numeral 30 in FIGS. 2A and 2B. In some instances, the applied ink may also inadvertently flow from the first surface 12 onto the second surface 14.

After the inkjet printing takes place on the first surface 12, it is desired to transport the card 10 to a curing station to fully cure the applied radiation curable ink on the first surface 12. However, the card 10 needs to be transported using a transport mechanism that does not contact the first surface 12 in order to avoid marring the applied ink before the ink has been fully cured. This means that the card 10 needs to be transported by contacting one or more of the side edge surfaces and/or by contacting the second surface 14, i.e. the card is transported using a transport mechanism that contacts a non-printed surface of the card 10. However, if any overflow 30 of the applied ink occurs on one of the non-printed surfaces, and the overflow 30 of ink has not been at least partially cured, the transport mechanism may contact the uncured overflow 30 of ink which can contaminate the transport mechanism and possibly damage the transport mechanism.

To prevent contamination and/or damage to the transport mechanism, any of the overflow 30 ink on one of the non-printed surfaces is at least partially cured prior to transporting the card 10 to a curing station to fully cure the applied ink on the first surface 12. In particular, electromagnetic radiation is discharged from an electromagnetic radiation source, and at least a portion of the electromagnetic radiation is directed onto one or more, or all, of the non-printed surfaces of the plastic card 10 to thereby at least partially cure any of the radiation curable ink on the non-printed surface. The electromagnetic radiation can be directed onto the entire perimeter side edge surface 24, or onto some or all of the first and/or second longitudinal side edge surfaces 24*a*, or onto some or all of the first and/or second end side edge surfaces 24*b*, or onto some or all of the second surface 14 especially near the junction with the perimeter side edge surface 24, or any combination thereof.

The at least partial curing of any overflow ink on the non-printed surface(s) is achieved using a suitable curing mechanism that includes an electromagnetic radiation source. The curing of the overflow ink on the non-printed surface(s) using the curing mechanism is distinct from any curing that may accidentally happen as a result of stray light impinging on the non-printed surface(s). The electromagnetic radiation source that is used is one that is suitable for the type of radiation curable ink being used. For example, in the case where the radiation curable ink is UV ink, the electromagnetic radiation source is a UV radiation source. The curing mechanism further includes at least one optical instrument that serves to direct the electromagnetic radiation from the radiation source onto the desired non-printed surface(s). The optical instrument(s) can be any one or more optical instruments suitable for achieving the desired directing of the electromagnetic radiation onto the non-printed surface(s) described herein including, but not limited to, one or more mirrors, one or more focusing lenses, one or more optical fibers, one or more light pipes, and the like, and combinations thereof.

FIG. 3 illustrates one example of a curing mechanism 40 that can be used. In this example, the curing mechanism 40 can include an electromagnetic radiation source 42 that emits electromagnetic radiation 44. The electromagnetic radiation source 42 can be located on the side of the card 10 facing toward the first surface 12 (to which the ink has been applied), or as illustrated in broken lines the electromagnetic radiation source 42 can be located on the side of the card 10 facing toward the non-printed second surface 14. The curing mechanism 40 further includes one or more optical instruments 46 that are positioned and configured to direct the emitted radiation 44 onto one or more of the non-printed surfaces of the card 10. In this example, with the radiation source 42 facing the first surface 12, the optical instruments 46 are shown reflecting the discharged radiation onto the first and second longitudinal side edge surfaces 24*a* of the card 10 as well as onto a portion of the second surface 14 near the junction with the side edge surfaces 24*a*. If considered necessary, similar optical instruments (not shown) can be used to reflect radiation onto the first and second end side edges surfaces 24*b*. The optical instruments 46 can each be curved mirrors (shown on the right in FIG. 3) or flat mirrors (shown on the left in FIG. 3). The mirror(s) can be fixed or they can be actuated or steerable. The source 42 and/or the optical instruments 46 can extend the entire length L of the card 10 so that the entire side edge surface 24*a* is simultaneously cured. Alternatively, the source 42 and/or the optical instruments 46 can be actuated to move relative to the card 10 in order to be able to at least partially cure the entire length of the side edge surfaces 24*a*. In some embodiments, the card 10 could be actuated past the source 42 and the optical instruments 46 which are fixed in position.

FIG. 4 illustrates another example of the curing mechanism 40 that can be used. In this example, the curing mechanism 40 can include the electromagnetic radiation source 42 that emits electromagnetic radiation. One or more optical instruments 46 in the form of one or more optical fibers direct radiation emitted from the source 42 onto one or more of the non-printed surfaces of the card 10, for example onto the first longitudinal side edge surface 24*a*. A similar optical fiber can be used to direct emitted radiation from the source 42 onto the second longitudinal side edge surface 24*a*, or a second radiation source and optical fiber can be used. In this embodiment, the source 42 can be located at a position relatively remote from the card 10 so that radiation emitted from the source 42 does not prematurely cure the ink applied to the surface 12. The optical fiber(s) then precisely directs the radiation onto the desired non-printed surface of the card 10. The optical fiber can be moved relative to the first longitudinal side edge surface 24*a* to be able to at least partially cure the entire length of the side edge surface 24*a*, or in some embodiments the card 10 could be actuated past the optical fiber which is fixed in position. One or more optical fibers could also be used to direct radiation onto one or more of the end edge surfaces 24*b* and/or onto portions of the second surface 14.

FIG. 5 illustrates another example of the curing mechanism 40 that can be used. In this example, the curing mechanism 40 can include the electromagnetic radiation source 42 that emits electromagnetic radiation. In this embodiment, the optical instrument 46 is an array of optical fibers that direct the radiation emitted from the source 42 onto one or more of the non-printed surfaces of the card 10, for example onto the first longitudinal side edge surface 24*a*. The optical fiber array is sized to extend along substantially the entire length L of the card 10 so that the radiation is directed onto the entire length of the non-printed surface of the card 10. A similar optical fiber array can be used to direct emitted radiation from the source 42 onto the second longitudinal side edge surface 24*a*, or a second radiation source and optical fiber array can be used. One or more optical fiber arrays could also be used to direct radiation onto one or more of the end edge surfaces 24*b* and/or onto portions of the second surface 14.

FIG. 6 illustrates another example of the curing mechanism 40 that can be used. In this example, the curing mechanism 40 can include the electromagnetic radiation source 42 that emits electromagnetic radiation. The optical instrument 46 is in the form of a focusing lens that focusses radiation emitted from the source 42 onto one or more of the non-printed surfaces of the card 10. This example illustrates the radiation being directed onto one of the end edge surfaces 24*b*. The curing mechanism 40 can be moved relative to the card 10 in order to be able to at least partially cure the entire width W of the non-printed surface of the card 10, or in some embodiments the card 10 could be actuated relative to the curing mechanism 40 which is fixed in position. A lens system with a focusing lens could also be used to direct radiation from the source 42 onto the other end edge surface 24*b*, or a second radiation source and focusing lens can be used. One or more lens systems including focusing lenses could also be used to direct radiation onto one or more of the side edge surfaces 24*a* and/or onto portions of the second surface 14.

The curing mechanism 40 can have many other configurations and can utilize many other types and combination of optical instruments that reflect, focus or otherwise direct radiation onto the desired non-printed surface, including combinations of the features in FIGS. 3 to 6. In one embodiment, the curing mechanism 40 can be configured to apply what can be referred to as low energy or low light intensity radiation to the non-printed surface(s) so that any ink on the non-printed surface(s) achieves a higher viscosity state but stops short of full or complete curing (i.e. partial curing). This can be referred to as pinning or UV pinning of the non-printed surface.

The inkjet printing and the at least partial curing described herein can occur in a system referred to as a plastic card processing system. Many examples of plastic card processing systems are known in the art. One known type of system is a large volume batch plastic card production machine, often configured with multiple processing stations or modules, typically referred to as a central issuance system, that processes multiple plastic cards at the same time and is designed to personalize plastic cards in relatively large volumes, for example measured in the high hundreds or even thousands per hour. An example of a central issuance system is the MX or MPR-lines of central issuance systems available from Entrust Datacard Corporation of Shakopee, Minn. Additional examples of central issuance systems are disclosed in U.S. Pat. Nos. 4,825,054, 5,266,781, 6,783,067, and 6,902,107, all of which are incorporated herein by reference in their entirety. Another known type of system is a desktop plastic card printer that has a relatively small footprint intended to permit the desktop plastic card printer to reside on a desktop and that is designed to personalize plastic cards in relatively small volumes, for example measured in tens or low hundreds per hour. An example of a desktop plastic card printer is the CD800 Card Printer available from Entrust Datacard Corporation of Shakopee, Minn. Additional examples of desktop printers are disclosed in U.S. Pat. Nos. 7,434,728 and 7,398,972, each of which is incorporated herein by reference in its entirety.

FIG. 7 schematically depicts one embodiment of a plastic card processing system 50 in which the techniques described herein can be implemented. The system 50 is configured as a central issuance system with multiple processing stations or modules. The system 50 includes a plastic card printing station 52, a curing station 54, a full curing station 56, and a plastic card transport mechanism 58. The system 50 can also include a card input 60, one or more optional additional card processing stations 62 between the card input 60 and the plastic card printing station 52, one or more optional additional card processing stations 64 between the curing station 54 and the full curing station 56, one or more optional additional card processing stations 66, and a card output 68. Each plastic card progresses through the system 50 generally in the direction of the arrow C (i.e. a card transport direction).

The plastic card printing station 52 includes a plastic card inkjet printing mechanism (not illustrated) that applies radiation curable ink to the printed surface of the plastic card. The inkjet printing mechanism may also be referred to as a drop-on-demand (DOD) printing mechanism. The general construction and operation of plastic card inkjet printing mechanisms is well-known in the art. One example of a conventional plastic card inkjet printing mechanism is found in the Persomaster card personalization system available from Atlantic Zeiser GmbH of Emmingen, Germany. The plastic card inkjet printing mechanism can have a single printhead for printing a single color, or multiple printheads for printing multiple colors, such as cyan, magenta, yellow, black and white (CMYKW).

The curing station 54 includes one or more of the curing mechanisms 40. The curing station 54 can be considered a separate station from the plastic card printing station 52 as shown in FIG. 7. Alternatively, the curing station 54 can be considered to be integrated into the plastic card printing station 52 as shown in FIG. 8 so that the plastic card printing station 52 and the curing station 54 are considered a single, unitary, integrated station. The curing station 54 is positioned relative to the plastic card printing station such that curing of any ink on the non-printed surfaces of the plastic card in the curing station 54 can occur immediately after printing in the plastic card printing station 52 without transporting the card after printing is completed. Or the card can be transported to the curing station 54, for example using a vacuum platen that contacts the second surface 14, after printing in the plastic card printing station 52 is completed.

The full curing station 56 is configured to completely cure the radiation curable ink applied to the printed surface, and possibly fully cure any partially cured ink on the non-printed surface(s). An example of a full curing station that applies UV radiation in a card printing system is the Persomaster card personalization system available from Atlantic Zeiser GmbH of Emmingen, Germany.

The plastic card transport mechanism 58 is configured to transport the plastic card from the curing station 54 to the full curing station 56 by contacting only non-printed surfaces of the plastic card. For example, the plastic card transport mechanism 58 could transport the plastic card by engaging just the first and second longitudinal side edge surfaces 24*a*, or the plastic card transport mechanism 58 could transport the plastic card by engaging just the second surface 14 (assuming the first surface 12 is the printed surface). Examples of card transport mechanisms that can transport a plastic card by engaging just the longitudinal side edge surfaces are disclosed in U.S. Published Application No. 2013/0220984 the entire contents of which are incorporated herein by reference. Examples of card transport mechanisms that can transport a plastic card by engaging just the second surface (or the first surface) using a vacuum platen are described in U.S. Published Application No. 2018/0326763 the entire contents of which are incorporated herein by reference.

The card input 60 is configured to hold a plurality of plastic cards waiting to be processed. Cards are fed one-by-one from the card input 60 into the rest of the system 50 where each card is individually processed. Processed plastic cards are ultimately transported into the card output 68 that is configured to hold a plurality of the processed plastic cards.

The optional additional card processing station(s) 62 can be between the card input 60 and the plastic card printing station 52. The optional additional card processing station(s) 64 can be between the curing station 54 and the full curing station 56. The optional additional card processing station(s) 66 can be between the full curing station 56 and the card output 68. The optional additional card processing station(s) 62, 64, 66 can be plastic card processing stations known in the art to perform plastic card processing operations that are known in the art. For example, the optional additional card processing stations can include a magnetic stripe read/write system that is configured to read data from and/or write data to the magnetic stripe 28, and/or an integrated circuit chip programming system that is configured to program the integrated circuit chip 26. Magnetic stripe read/write systems and integrated circuit chip programming systems are disclosed, for example, in U.S. Pat. Nos. 6,902,107 and 6,695,205 the entire contents of which are incorporated herein by reference, and can be found in the MX family of central issuance systems available from Entrust Datacard Corporation of Shakopee, Minn. The optional additional card processing station(s) 62, 64, 66 can also be configured to perform one or more of embossing; indenting; laminating; laser marking; apply a topcoat; a quality control station that is configured to check the quality of personalization/processing applied to the cards; a security station that is configured to apply a security feature such as a holographic foil patch to the cards; and other card processing operations.

Other than the plastic card transport mechanism 58, transport of the plastic cards in other portions of the system 50 can occur using conventional card transport mechanisms that are known in the art. Examples of card transport mechanisms that could be used are known in the art and include, but are not limited to, transport rollers, transport belts (with tabs and/or without tabs), vacuum transport mechanisms, transport carriages, and the like and combinations thereof. Card transport mechanisms are well known in the art including those disclosed in U.S. Pat. Nos. 6,902,107, 5,837,991, 6,131,817, and 4,995,501 and U.S. Published Application No. 2007/0187870, each of which is incorporated herein by reference in its entirety. A person of ordinary skill in the art would readily understand the type(s) of card transport mechanisms that could be used, as well as the construction and operation of such card transport mechanisms.

FIG. 9 schematically depicts another embodiment of a plastic card processing system 80 in which the techniques described herein can be implemented. The system 80 is configured as a desktop plastic card processing system. The system 80 includes the plastic card printing station 52, the curing station 54, the full curing station 56, the plastic card transport mechanism 58, the card input 60, the one or more optional additional card processing stations 62, and the card output 68, each of which is contained within a common housing 70. In some embodiments, the card input 60 and the card output 68 can be located at the same end of the housing 70, while in other embodiments the card input 60 and the card output 68 can be located at opposite ends of the housing 70, or the card input 60 can be located at the top of the housing 70 and the card output 68 located at one of the ends of the housing 70.

Like with the system 50, transport of the plastic cards in other portions of the system 80 other than the plastic card transport mechanism 58 can occur using conventional card transport mechanisms that are known in the art. Examples of card transport mechanisms that could be used are known in the art and include, but are not limited to, transport rollers, transport belts (with tabs and/or without tabs), vacuum transport mechanisms, transport carriages, and the like and combinations thereof. Card transport mechanisms are well known in the art including those disclosed in U.S. Pat. Nos. 6,902,107, 5,837,991, 6,131,817, and 4,995,501 and U.S. Published Application No. 2007/0187870, each of which is incorporated herein by reference in its entirety. A person of ordinary skill in the art would readily understand the type(s) of card transport mechanisms that could be used, as well as the construction and operation of such card transport mechanisms.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of inkjet printing on a plastic card, comprising:

applying radiation curable ink to a first surface of the plastic card near an edge thereof; and thereafter discharging electromagnetic radiation from an electromagnetic radiation source and directing at least a portion of the discharged electromagnetic radiation onto a non-printed surface of the plastic card using at least one optical instrument to thereby at least partially cure any of the radiation curable ink on the non-printed surface; and wherein the non-printed surface is a perimeter side edge surface of the plastic card, and/or a second surface of the plastic card opposite the first surface, wherein the perimeter side edge surface intersects the first surface and the second surface.

2. The method of claim 1, wherein the radiation curable ink is ultraviolet radiation curable ink, and the electromagnetic radiation source is an ultraviolet light source that discharges ultraviolet radiation.

3. The method of claim 1, wherein the at least one optical instrument reflects the discharged electromagnetic radiation.

4. The method of claim 3, wherein the at least one optical instrument comprises a mirror or an optical fiber.

5. The method of claim 1, wherein the perimeter side edge surface includes first and second longitudinal side edge surfaces and first and second end side edge surfaces; and directing at least a portion of the discharged electromagnetic radiation onto the non-printed surface of the plastic card comprises directing the portion of the discharged electromagnetic radiation onto at least one of the first and second longitudinal side edge surfaces and/or onto at least one of the first and second end side edge surfaces.

6. The method of claim 5, wherein directing at least a portion of the discharged electromagnetic radiation onto the non-printed surface of the plastic card comprises directing the portion of the discharged electromagnetic radiation onto two or more of the first and second longitudinal side edge surfaces and the first and second end side edge surfaces.

7. The method of claim 1, comprising directing at least a portion of the discharged electromagnetic radiation onto the second surface and onto the perimeter side edge surface.

8. The method of claim 1, wherein applying the radiation curable ink to the first surface of the plastic card comprises applying the radiation curable ink to the entire first surface.

9. The method of claim 1, wherein directing at least the portion of the discharged electromagnetic radiation onto the non-printed surface of the plastic card occurs prior to fully curing the radiation curable ink applied to the first surface.

10. A method of processing a plastic card, comprising:

applying radiation curable ink to a first surface of the plastic card in a plastic card printing station having a plastic card inkjet printing mechanism; and thereafter at least partially curing any of the radiation curable ink on a non-printed surface of the plastic card using electromagnetic radiation directed onto the non-printed surface using at least one optical instrument; and wherein the non-printed surface is a perimeter side edge surface of the plastic card, and/or a second surface of the plastic card opposite the first surface, wherein the perimeter side edge surface intersects the first surface and the second surface.

11. A plastic card processing system, comprising:

a plastic card printing station having a plastic card inkjet printing mechanism that applies radiation curable ink to a first surface of a plastic card;

an electromagnetic radiation source that generates and discharges electromagnetic radiation; and at least one optical instrument that is positioned relative to the electromagnetic radiation source to receive at least a portion of the electromagnetic radiation discharged by the electromagnetic radiation source and that is configured to direct electromagnetic radiation onto a non-printed surface of the plastic card; and wherein the non-printed surface is a perimeter side edge surface of the plastic card, and/or a second surface of the plastic card opposite the first surface, wherein the perimeter side edge surface intersects the first surface and the second surface.

12. The plastic card processing system of claim 11, wherein the electromagnetic radiation source and the at least one optical instrument are part of a curing station.

13. The plastic card processing system of claim 12, further comprising a second curing station that fully cures the radiation curable ink applied to the first surface, the second curing station is located downstream from the curing station in a card transport direction.

14. The plastic card processing system of claim 13, further comprising a plastic card transport mechanism that transports the plastic card from the curing station to the second curing station without contacting the first surface of the plastic card.

15. The plastic card processing system of claim 12, wherein the curing station is separate from the plastic card printing station or incorporated into the plastic card printing station.

16. The plastic card processing system of claim 13, further comprising at least one integrated circuit chip programming station located prior to the plastic card printing station or located after the second curing station.

17. The plastic card processing system of claim 12, wherein the at least one optical instrument comprises a mirror or an optical fiber.

* * * * *